US012773086B2

(12) United States Patent
Huang

(10) Patent No.: US 12,773,086 B2
(45) Date of Patent: Oct. 27, 2026

(54) HAND-PRESS TYPE ROTARY CLEANING ASSEMBLY

(71) Applicant: Yi-Hsuan Huang, Taoyuan (TW)

(72) Inventor: Yi-Hsuan Huang, Taoyuan (TW)

( * ) Notice: Subject to any disclaimer, the term of this patent is extended or adjusted under 35 U.S.C. 154(b) by 289 days.

(21) Appl. No.: 18/701,568

(22) PCT Filed: Oct. 15, 2021

(86) PCT No.: PCT/CN2021/123950
§ 371 (c)(1),
(2) Date: Apr. 15, 2024

(87) PCT Pub. No.: WO2023/060522
PCT Pub. Date: Apr. 20, 2023

(65) Prior Publication Data
US 2024/0415360 A1 Dec. 19, 2024

(51) Int. Cl.
*A47L 13/58* (2006.01)
*A47L 13/42* (2006.01)

(52) U.S. Cl.
CPC ..... *A47L 13/42* (2013.01); *A47L 13/58* (2013.01)

(58) Field of Classification Search
CPC ..... A47L 13/42; A47L 13/58; A47L 13/14; A47L 13/142
See application file for complete search history.

(56) References Cited

U.S. PATENT DOCUMENTS

2009/0260169 A1* 10/2009 Chen ..... A47L 13/142 15/228
2011/0214241 A1 9/2011 Wang

FOREIGN PATENT DOCUMENTS

| | | | |
|---|---|---|---|
| CN | 101828893 | A | 9/2010 |
| CN | 201675891 | U | 12/2010 |
| CN | 201831831 | U | 5/2011 |
| CN | 204912171 | U | 12/2015 |
| CN | 210697444 | U | 6/2020 |
| TW | 201607488 | A | 3/2016 |
| TW | M562090 | U | 6/2018 |

* cited by examiner

*Primary Examiner* — Shay Karls
(74) *Attorney, Agent, or Firm* — Maschoff Brennan

(57) ABSTRACT

The invention discloses a hand-press type rotary cleaning assembly. The hand-press type rotary cleaning assembly includes a cleaning-element-allocating zone having a cylindrical surface whose whole surface area is covered with a cleaning element. The hand-press type rotary cleaning assembly comprises: a rotary rod; a connecting rod body including an attaching rod and the cleaning element covered around on the whole cylindrical surface of the cleaning-element-allocating zone; a gripping rod; a helix rod; a rotary guiding component having a helix perforation, the helix rod passing through the helix perforation to helically rotate within the helix perforation, wherein when the helix rod moves along a pressing-down direction, a helix structure drives the helix perforation to make the rotary guiding component rotate in a rotation direction; and a dehydrating device.

10 Claims, 7 Drawing Sheets

HAND-PRESS TYPE ROTARY CLEANING ASSEMBLY

FIELD OF THE INVENTION

The present invention relates to an environmental cleaning assembly and more particularly relates to a hand-press type rotary cleaning assembly, wherein the hand-press type rotary cleaning assembly includes a cleaning-element-allocating zone having a cylindrical surface whose whole surface area is covered with a cleaning element.

BACKGROUND OF THE INVENTION

The conventional environmental cleaning assembly of a duster includes a head portion having a shaft body and a cleaning element, e.g., a cloth cover, which covers an outer surface of the shaft body. The cleaning operation thereof is performed by using the cleaning elements having different angles relative to an axis of the shaft body, using the cleaning element at different positions along the longitudinal direction of the shaft body, and rolling the cleaning element relative to the shaft body. The conventional duster, compared to a mop, is with advantages including the cleaning area of cleaning element being broader, dynamic cleaning angle, and allowing the rotation of the cleaning element relative to the shaft body such as to make the duster unique.

However, the conventional duster is with drawback that its cleaning element is inconvenient to clean and maintain. A user usually needs to remove the cleaning element from the shaft body and then put the cleaning element into the washing machine for cleaning or manually cleaned. These operations may reduce the willingness to clean the cleaning element for users. Accordingly, the cleaning effect may be affected by insufficient cleanliness of the cleaning element.

Moreover, if either cleaning the cleaning element by the washing machine or by manually cleaned is considered, it is found the disadvantages that (1) the cleaning element is easily to be damaged, (2) the cleaning element could be neither cleaned properly nor easily, and (3) it is time-consuming and labor-intensive to wring out the cleaning element after washing the cleaning element. The above cause the usage of duster inconvenient.

Therefore, there is still a need to improve the environmental cleaning assembly of duster.

SUMMARY OF THE INVENTION

Therefore, one objective of the present invention is to provide a hand-press type rotary cleaning assembly, the hand-press type rotary cleaning assembly includes a cleaning-element-allocating zone having a cylindrical surface whose whole surface area is covered with a cleaning element, thereby improving the convenience in use, cleaning and maintenance.

In order to overcome the technical problems in the prior art, the present invention provides a hand-press type rotary cleaning assembly, the hand-press type rotary cleaning assembly including a cleaning-element-allocating zone having a cylindrical surface whose whole surface area is covered with a cleaning element, the hand-press type rotary cleaning assembly comprising: a rotary rod having a rotary rod housing, wherein an inner surface of the rotary rod housing is a rotary-rod-inside hollow body; a connecting rod body including an attaching rod and the cleaning element, wherein a top end of the attaching rod is attached to a bottom end of the rotary rod, a bottom end of the attaching rod is formed with a supporting portion, the cleaning-element-allocating zone is an entire area of a cylindrical surface of the attaching rod, and the cleaning element is covered around on the whole cylindrical surface of the cleaning-element-allocating zone; a gripping rod having a gripping rod housing, wherein an inner surface of the gripping rod housing is a gripping-rod-inside hollow body, the gripping-rod-inside hollow body accommodates the rotary rod such that the rotary rod is displaced in the gripping-rod-inside hollow body along an axis of the gripping-rod-inside hollow body; a helix rod, wherein a top end of the helix rod is secured to a top end of the inner surface of the gripping rod housing, and a helix structure is provided on a surface of the helix rod; a rotary guiding component firmly mounted within the rotary-rod-inside hollow body, wherein the rotary guiding component has a helix perforation, the helix rod passes through the helix perforation to helically rotate within the helix perforation to displace relative to the helix perforation such that when the helix rod moves along a pressing-down direction, the helix structure drives the helix perforation to make the rotary guiding component rotate in a rotation direction; and a dehydrating device including a bucket, a rotary shaft and a receiving assembly, wherein the rotary shaft is rotatably disposed in the bucket, the receiving assembly is disposed at a top end of the rotary shaft to receive the supporting portion of the connecting rod body, and the receiving assembly is formed with an engaging portion corresponding to the supporting portion.

In one embodiment of the present invention, the hand-press type rotary cleaning assembly is provided, wherein the hand-press type rotary cleaning assembly is a duster and the cleaning element is a cloth cover.

In one embodiment of the present invention, the hand-press type rotary cleaning assembly is provided, wherein the rotary guiding component further has a blocking element located at an outer periphery of the rotary guiding component.

In one embodiment of the present invention, the hand-press type rotary cleaning assembly is provided, wherein the hand-press type rotary cleaning assembly further comprises a rotary driven element firmly mounted within the rotary-rod-inside hollow body and encircling around a radial outer surface of the rotary guiding component, a corresponding blocking element is provided on a radial inner surface of the rotary driven element, the corresponding blocking element is corresponding in shape to the blocking element of the rotary guiding component when the blocking element extends outwardly while the rotary guiding component is rotating, the blocking element is attached to the rotary guiding component through a spin shaft, wherein the rotary rod, the gripping rod and the helix rod are provided extending along the pressing-down direction, the pressing-down direction is a direction opposite to a lifting-up direction, wherein when the gripping rod moves downwardly along the pressing-down direction and the rotary guiding component rotates in the pressing-down direction, the blocking element, which is hold by the spin shaft, swings outwardly by a centrifugal force to block the corresponding blocking element such that the rotary guiding component drives the rotary driven element, the rotary rod and the connecting rod body to rotate so as to rotate the attaching rod of the connecting rod body and the cleaning element covering the entire circumferential surface of the cleaning-element-allocating zone such that water in the connecting rod body is removed by the centrifugal force, and accordingly when an angular velocity of the rotary guiding component in the pressing-down direction is less than an angular velocity of the rotary driven element in the pressing-down direction, the blocking element swings inwardly such that the corresponding blocking element is not blocked by the blocking element, wherein when the gripping rod moves upwardly along the lifting-up direction and the rotary guiding component rotates in the lifting-up direction, the corresponding blocking element is not blocked by the blocking element, and wherein when the connecting rod body is placed on the receiving assembly in a manner that the supporting portion is engaged with the engaging portion and the connecting rod body rotates along the rotation direction, the connecting rod body drives the receiving assembly to rotate along the rotation direction.

In one embodiment of the present invention, the hand-press type rotary cleaning assembly is provided, wherein when the supporting portion is formed protruding from the bottom end of the attaching rod, the engaging portion is recessed from the receiving assembly corresponding to the supporting portion, and when the supporting portion is recessed from the bottom end of the attaching rod, the engaging portion is formed protruding from the receiving assembly corresponding to the supporting portion such that the supporting portion and the engaging portion are enable to engage with each other.

In one embodiment of the present invention, the hand-press type rotary cleaning assembly is provided, wherein the hand-press type rotary cleaning assembly further comprises an auxiliary restraining assembly fixed to the helix rod and movably accommodated within the rotary rod.

In one embodiment of the present invention, the hand-press type rotary cleaning assembly is provided, wherein the hand-press type rotary cleaning assembly further comprising a locking part located adjacent to an intersection of the rotary rod and the gripping rod and configured to secure a relative position between the rotary rod and the gripping rod.

In one embodiment of the present invention, the hand-press type rotary cleaning assembly is provided, wherein the blocking element is a blocking tab swingably disposed in an outer periphery of the rotary guiding component, and the corresponding blocking element is a blocking concave recessed in the rotary driven element.

In one embodiment of the present invention, the hand-press type rotary cleaning assembly is provided, wherein the rotary driven element includes a sleeve and a cap, the rotary guiding component is accommodated in the sleeve, and the cap covers the sleeve such that the rotary driven element is restrained in the sleeve.

In one embodiment of the present invention, the hand-press type rotary cleaning assembly is provided, wherein the connecting rod body is a replaceable connecting rod body, and a top end of the connecting rod body is detachably attached to the bottom end of the rotary rod.

By the technical means adopted by the hand-press type rotary cleaning assembly of the present invention, the cleaning element can be directly cleaned and maintained by the characteristic features including using the cleaning elements having different angles relative to the axis of the shaft body when dust brushing, using the cleaning element at different positions along the longitudinal direction of the shaft body when dust brushing, and applying the rotation of the cleaning element relative to the shaft body when cleaning the duster. Moreover, the present invention is with merit, compared to twisting and wringing by hands in prior arts, can more thoroughly remove the excess water on the cleaning element by the centrifugal force, thereby improving the convenience of the user in usage, cleaning and maintenance to achieve time-saving and labor-saving effects.

DETAILED DESCRIPTION OF THE PREFERRED EMBODIMENTS

The preferred embodiments of the present invention are described in detail with reference to FIGS. 1 to 4*b*. The description is used for explaining the embodiments of the present invention only, but not for limiting the scope of the claims.

Figure 1:
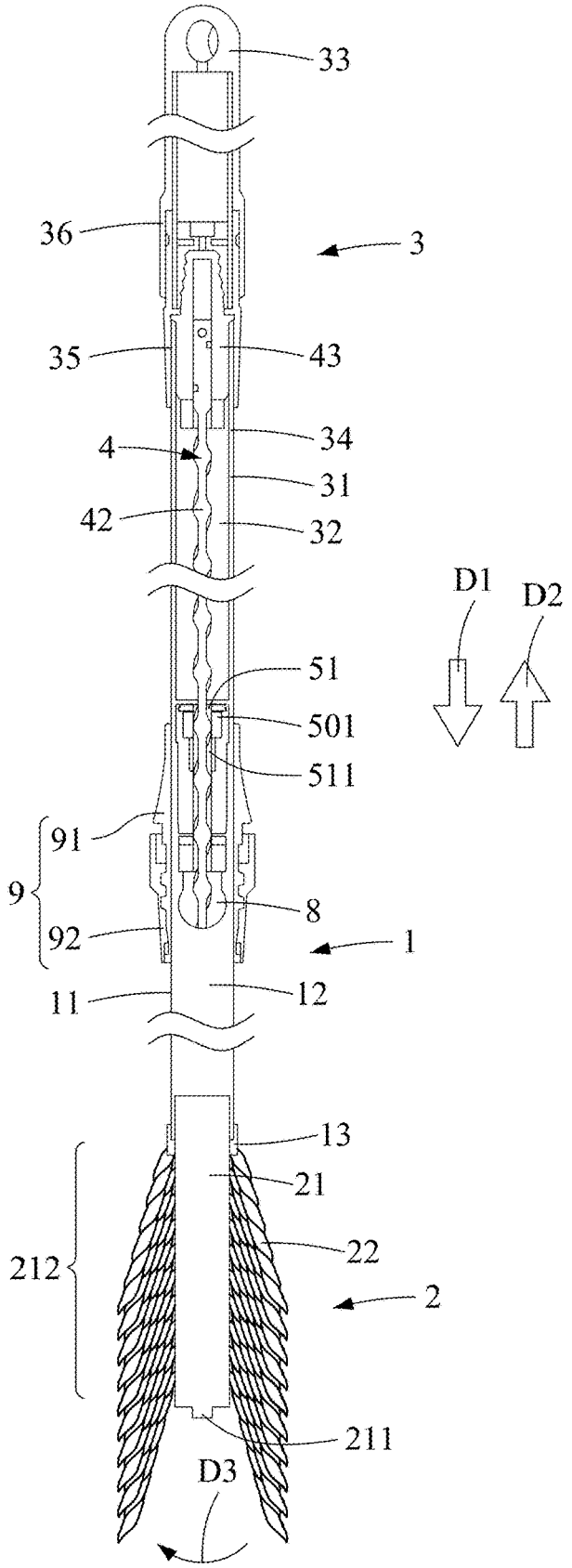
FIG. 1 is a schematic partial sectional view of a hand-press type rotary cleaning assembly according to one embodiment of the present invention.

As shown in FIG. 1, a hand-press type rotary cleaning assembly 100 according to one embodiment of the present invention comprises a rotary rod 1, a connecting rod body 2, a gripping rod 3, a helix rod 4, a rotary guiding component 5, a rotary driven element 6, a dehydrating device 7, an auxiliary restraining assembly 8 and a locking part 9. The rotary rod 1, the gripping rod 3 and the helix rod 4 are provided extending along the pressing-down direction D1, and the pressing-down direction D1 is a direction opposite to a lifting-up direction D2.

Figure 2A:
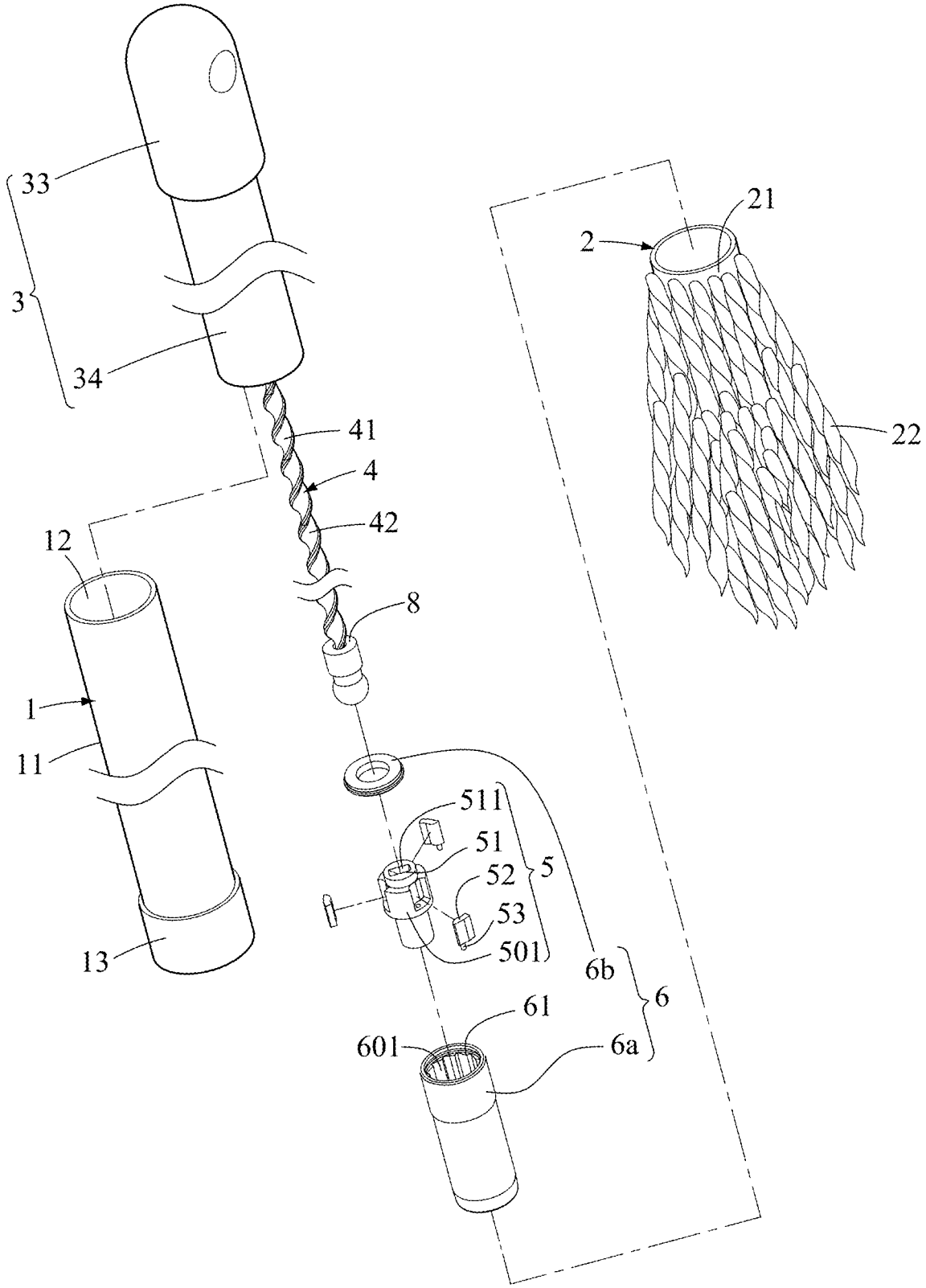
FIG. 2*a* is a schematic partial exploded view of the hand-press type rotary cleaning assembly according to the embodiment of the present invention.

As shown in FIGS. 1 to 2*a*, in the hand-press type rotary cleaning assembly 100 according to one embodiment of the present invention, the rotary rod 1 has a rotary rod housing 11, an inner surface of the rotary rod housing 11 is a rotary-rod-inside hollow body 12, and the rotary-rod-inside hollow body 12 extends along the pressing-down direction D1.

As shown in FIGS. 1, 2*a*, 4*a* and 4*b*, in the hand-press type rotary cleaning assembly 100 according to one embodiment of the present invention, the connecting rod body 2 includes an attaching rod 21 and a cleaning element 22, a top end of the attaching rod 21 is attached to a bottom end of the rotary rod 1, a bottom end of the attaching rod 21 is formed with a supporting portion 211, a cleaning-element-allocating zone 212 is an entire area of a cylindrical surface of the attaching rod 21, the cleaning element 22 is covered around on the whole cylindrical surface of the cleaning-element-allocating zone 212, the cleaning element 22 is made of a material that easily absorbs dust, dirt or moisture and is easily to clean, and in the embodiment, the hand-press type rotary cleaning assembly 100 is a duster and the cleaning element 22 is a cloth cover.

As shown in FIGS. 1 and 2*a*, in the hand-press type rotary cleaning assembly 100 according to one embodiment of the present invention, the gripping rod 3 has a gripping rod housing 31, an inner surface of the gripping rod housing 31 is a gripping-rod-inside hollow body 32, the gripping-rod-inside hollow body 32 extends along the pressing-down direction D1, the gripping-rod-inside hollow body 32 accommodates the rotary rod 1 such that the rotary rod 1 is displaced in the gripping-rod-inside hollow body 32.

As shown in FIG. 1, in the hand-press type rotary cleaning assembly 100 according to one embodiment of the present invention, the gripping rod 3 further includes a first gripping rod 33, a second gripping rod 34, an attaching component 35 and a rotating gripping sleeve 36. The first gripping rod 33 communicates with the second gripping rod 34. The attaching component 35 attaches the first gripping rod 33 to the second gripping rod 34, and the rotating gripping sleeve 36 is rotatably mounted on the attaching component 35.

As shown in FIG. 1, in the hand-press type rotary cleaning assembly 100 according to one embodiment of the present invention, the hand-press type rotary cleaning assembly 100 further comprises the locking part 9, the locking part 9 is located adjacent to an intersection of the rotary rod 1 and the gripping rod 3 and configured to secure a relative position between the rotary rod 1 and the gripping rod 3. The locking part 9 has a first locking component 91 and a second locking component 92. The first locking component 91 and the second locking component 92 may be a hollow cylindrical structure, the first locking component 91 may be mounted on an outer surface of a bottom end of the gripping rod housing 31 and be located adjacent to or fitted to an outer surface of the rotary rod housing 11. The second locking component 92 may be mounted to an outer surface of a bottom end of the first locking component 91, and when the second locking component 92 is locked to the first locking component 91, the first locking component 91 locks both the rotary rod 1 and the gripping rod 3.

As shown in FIG. 1, in the hand-press type rotary cleaning assembly 100 according to one embodiment of the present invention, the helix rod 4 is accommodated in the gripping-rod-inside hollow body 32 or the rotary-rod-inside hollow body 12 in a manner that a top end of the helix rod 4 is secured to the inner surface of the gripping rod housing 31, a helix structure 41 is provided on a surface of the helix rod 4, wherein the position where the helix rod 4 is secured to the inner surface of the gripping rod housing 31 is not limited.

As shown in FIG. 1, in the hand-press type rotary cleaning assembly 100 according to one embodiment of the present invention, the helix rod 4 further includes a screw bolt 42 and a screw bolt retaining component 43. The screw bolt 42 extends along the pressing-down direction D1, and when the screw bolt 42 is accommodated in the gripping-rod-inside hollow body 32 or the rotary-rod-inside hollow body 12, the screw bolt 42 may not be in contact with the inner surface of the gripping rod housing 31 or the inner surface of the rotary rod housing 11, that is, a diameter of the screw bolt 42 is less than a diameter of the gripping rod 3 or a diameter of the rotary rod 1. The screw bolt retaining component 43 may be retained to an up end of the screw bolt 42.

As shown in FIGS. 1 to 2*a*, in the hand-press type rotary cleaning assembly 100 according to one embodiment of the present invention, the hand-press type rotary cleaning assembly 100 further includes the auxiliary restraining assembly 8, the auxiliary restraining assembly 8 is fixed to a bottom end of the helix rod 4 and movably accommodated within the rotary rod 1, the auxiliary restraining assembly 8 may be made of an elastic material, a width of the auxiliary restraining assembly 8 is less than the diameter of the rotary rod 1 and greater than the diameter of the screw bolt 42, thereby preventing the bottom end of the screw bolt 42 from directly colliding with the inner surface of the rotary rod housing 11 and increasing a rotation smoothness of the rotary rod 1 or a displace smoothness of the gripping rod 3.

As shown in FIGS. 1 to 2*a*, in the hand-press type rotary cleaning assembly 100 according to one embodiment of the present invention, the rotary guiding component 5 is firmly mounted within the rotary-rod-inside hollow body 12, the rotary guiding component 5 has a helix perforation 51, the helix rod 4 passes through the helix perforation 51 to helically rotate within the helix perforation 51 to displace relative to the helix perforation 51, wherein when the helix rod 4 moves along the pressing-down direction D1, the helix structure 41 drives the helix perforation 51 to make the rotary guiding component 5 rotate in a rotation direction D3.

In detail, as shown in FIGS. 1 and 2*a*, in the hand-press type rotary cleaning assembly 100 according to one embodiment of the present invention, the helix perforation 51 of the rotary guiding component 5 has an inner thread structure 511 compatible with the helix structure 41 of the helix rod 4. Therefore, when the helix rod 4 is downwardly pressed to slide relative to the rotary guiding component 5, the helix structure 41 of the helix rod 4 drives the helix perforation 51 to rotate the rotary guiding component 5 along the pressing-down direction D1. Moreover, when the helix rod 4 is upwardly pulled to slide relative to the rotary guiding component 5, the helix structure 41 of the helix rod 4 drives the helix perforation 51 to rotate the rotary guiding component 5 along the lifting-up direction D2.

Figure 2B:
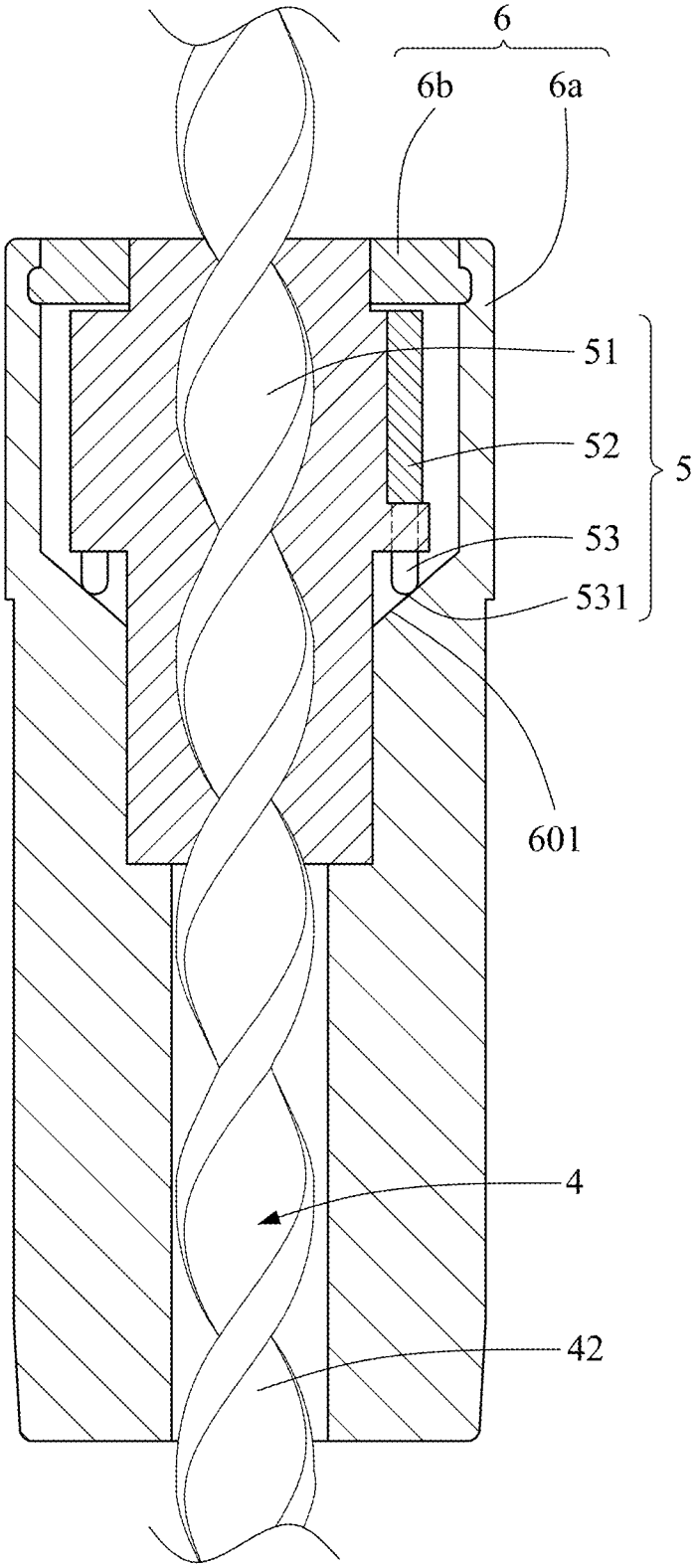
FIG. 2*b* is a schematic partial sectional view of the hand-press type rotary cleaning assembly according to the embodiment of the present invention.

As shown in FIGS. 1, 2*a* and 2*b*, in the hand-press type rotary cleaning assembly 100 according to one embodiment of the present invention, the hand-press type rotary cleaning assembly 100 further includes the rotary driven element 6, the rotary driven element 6 is firmly mounted within the rotary-rod-inside hollow body 12 and encircles around a radial outer surface 501 of the rotary guiding component 5, and a corresponding blocking element 61 is provided on a radial inner surface 601 of the rotary driven element 6, the corresponding blocking element 61 is corresponding in shape to the blocking element 52 of the rotary guiding component 5 when the blocking element 61 extends outwardly while the rotary guiding component 5 is rotating.

In detail, as shown in FIGS. 2*a* and 2*b*, in the embodiment, the rotary driven element 6 includes a sleeve 6*a* and a cap 6*b*. The rotary guiding component 5 is accommodated in the sleeve 6*a*, and the cap 6*b* covers the sleeve 6*a* such that the rotary driven element 6 is restrained in the sleeve 6*a*. The sleeve 6*a* is mounted to the attaching rod 21 of the connecting rod body 2 such that the connecting rod body 2 rotates with the sleeve 6*a*.

Figure 3A:
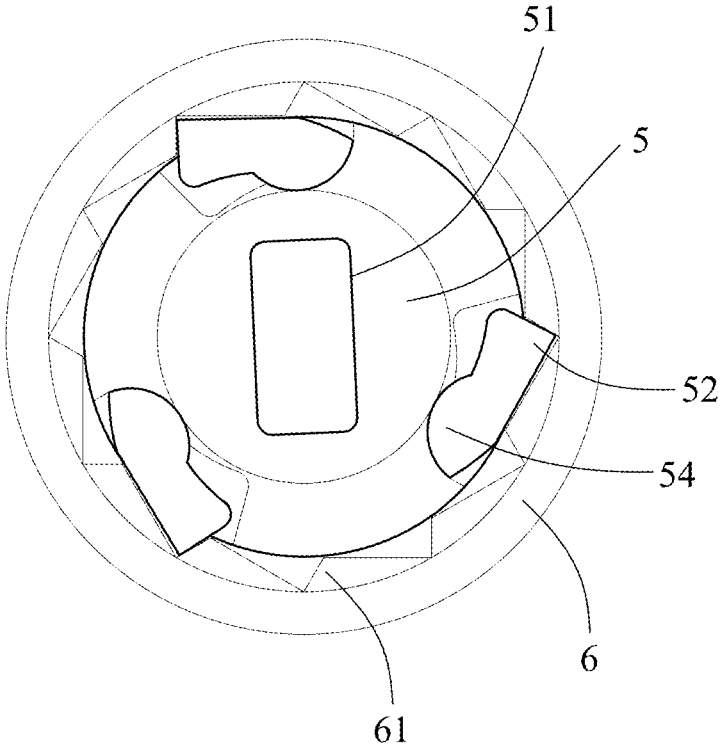
FIG. 3*a* is a schematic sectional view of a rotary guiding component of the hand-press type rotary cleaning assembly according to the embodiment of the present invention in a pressing-down direction.
Figure 3B:
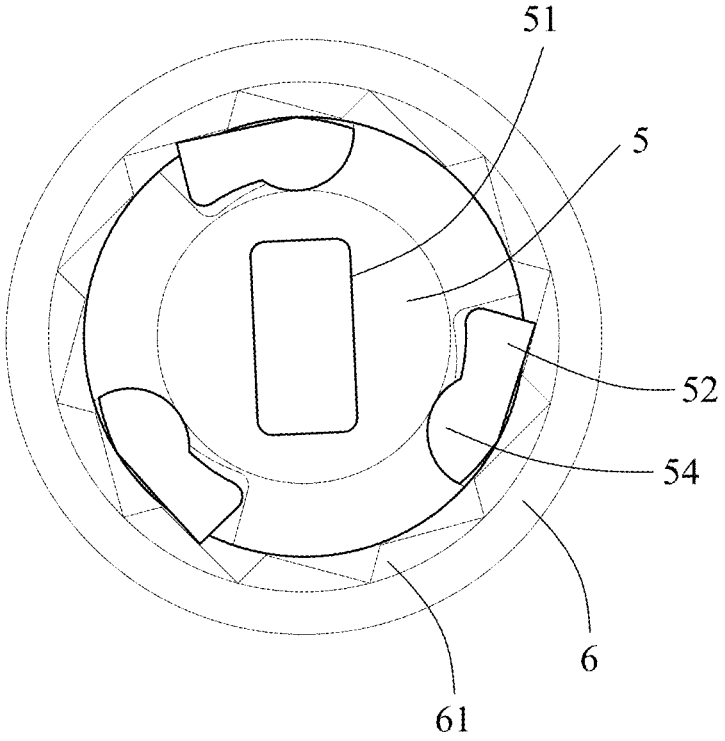
FIG. 3*b* is a schematic sectional view of the hand-press type rotary cleaning assembly according to the embodiment of the present invention when the rotary guiding component has an angular velocity in the pressing-down direction less than that of a rotary driven element.
Figure 3C:
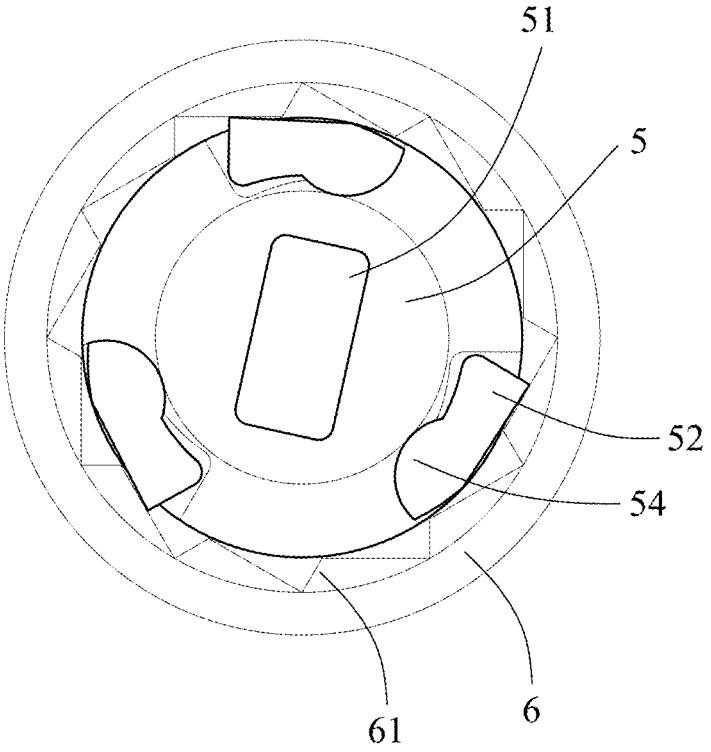
FIG. 3*c* is a schematic sectional view of the rotary guiding component of the hand-press type rotary cleaning assembly according to the embodiment of the present invention in a lifting-up direction

As shown in FIGS. 1 and 3*a*, in the hand-press type rotary cleaning assembly 100 according to one embodiment of the present invention, the blocking element 52 is attached to the rotary guiding component 5 through a spin shaft 53, and a radial outer surface 531 of the spin shaft 53 is fitted to the radial inner surface 601 of the rotary driven element 6, wherein when the gripping rod 3 moves downwardly along the pressing-down direction D1 and the rotary guiding component 5 rotates in the pressing-down direction D1, the blocking element 52, which is hold by the spin shaft 53, swings outwardly by a centrifugal force to block the corresponding blocking element 61 such that the rotary guiding component 5 drives the rotary driven element 6, the rotary rod 1 and the connecting rod body 2 to rotate so as to rotate the attaching rod 21 of the connecting rod body 2 and the cleaning element 22 covering the entire circumferential surface of the cleaning-element-allocating zone 212 such that water in the connecting rod body 2 is removed by the centrifugal force. As shown in FIGS. 1 and 3*b*, when an angular velocity of the rotary guiding component 5 in the pressing-down direction D1 is less than an angular velocity of the rotary driven element 6 in the pressing-down direction D1, the blocking element 52 swings inwardly such that the corresponding blocking element 61 is not blocked by the blocking element 52, and as shown in FIGS. 1 and 3*c*, when the gripping rod 3 moves upwardly along the lifting-up direction D2 and the rotary guiding component 5 rotates in the lifting-up direction D2, the corresponding blocking element 61 is not blocked by the blocking element 52. As shown in FIG. 4*b*, when the connecting rod body 2 is placed on the receiving assembly 73 in a manner that the supporting portion 211 is engaged with the engaging portion 731 and the connecting rod body 2 rotates along the rotation direction D3, the connecting rod body 2 drives the receiving assembly 73 to rotate along the rotation direction D3.

In detail, as shown in FIG. 2*a*, in the embodiment, the blocking element 52 of the rotary guiding component 5 is a blocking tab, the blocking tab has a rotating shaft 53. The blocking tab, i.e., the blocking element 52, is attached to an outer periphery of the rotary guiding component 5 by the rotating shaft 53. The rotating shaft 53 is served as a swinging pivot such that the swinging of the blocking tab is smooth. Preferably, as shown in FIG. 2*b*, a radial outer surface 531 of the rotating shaft 53 is fitted to the radial inner surface 601 of the rotary driven element 6 to be rotated by a frictional force therebetween. In detail, as shown in FIGS. 3*a* to 3*c*, the blocking tab has a pivoting portion 54, the pivoting portion 54 has a curved outer edge configuration to pivot in an outer periphery of the rotary guiding component 5 such that the blocking tab can pivot and swing. In the embodiment, the corresponding blocking element 61 is a blocking concave recessed in the rotary driven element 6.

In detail, as shown in FIGS. 1 and 3*a*, when the rotary guiding component 5 rotates in the pressing-down direction D1, the blocking element 52, i.e., the blocking tab, is driven to rotate by the centrifugal force or by the rotating shaft 53 rotated by the frictional force between the rotating shaft 53 and the rotary driven element 6 to swing outwardly to correspondingly block the corresponding blocking element 61, i.e., the blocking concave, to engage with each other, thereby rotating the rotary driven element 6 with the rotary guiding component 5. The rotary driven element 6 drives the rotary rod 1, the attaching rod 21 of the connecting rod body 2 and cleaning element 22 covered around on the whole cylindrical surface of the cleaning-element-allocating zone 212 of the attaching rod 21 to rotate. Then, as shown in FIGS. 1 and 3*b*, when the rotating speed of the rotary guiding component 5 slows down or stops (e.g., when the helix rod 4 is downwardly pressed to slide to a lowest position) and the angular velocity of the rotary guiding component 5 in the pressing-down direction D1 is less than an angular velocity of the rotary driven element 6 in the pressing-down direction D1, the blocking tab is pushed by the blocking concave to swing inwardly or the blocking tab swings inwardly together with the rotating shaft 53 (as shown in FIG. 2*b*) rotated by the frictional force between the rotating shaft 53 and the rotary driven element 6 such that the blocking concave is not blocked by the blocking tab and the rotary driven element 6 continues to maintain rotation without slowing down or stopping with the rotary guiding component 5. Then, as shown in FIGS. 1 and 3*c*, when the rotary guiding component 5 rotates in the lifting-up direction D2 (e.g., when the helix rod 4 is upwardly pulled to slide), the blocking tab is also pushed by the blocking concave to inwardly swing, the corresponding blocking element 61 is not blocked by the blocking element 52, and thus the rotary driven element 6 continues to maintain rotation without slowing down or stopping with the rotary guiding component 5

Figure 4A:
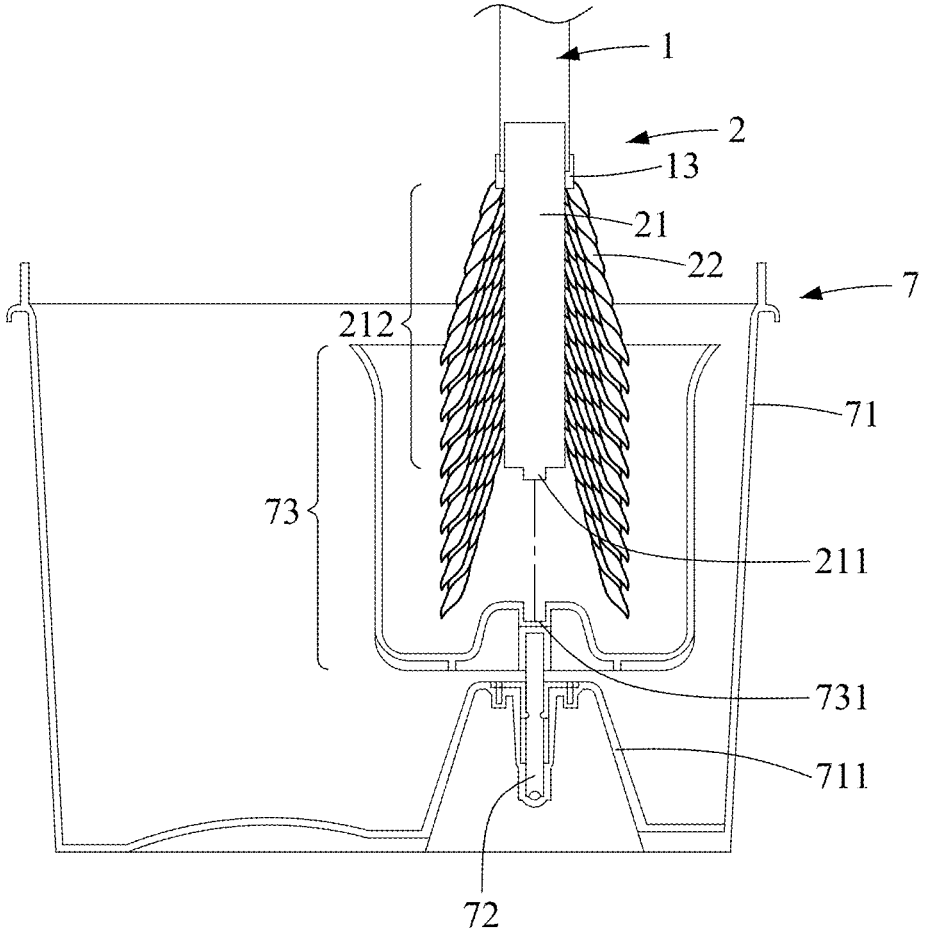
FIG. 4*a* is a schematic partial sectional view of the hand-press type rotary cleaning assembly according to the embodiment of the present invention.
Figure 4B:
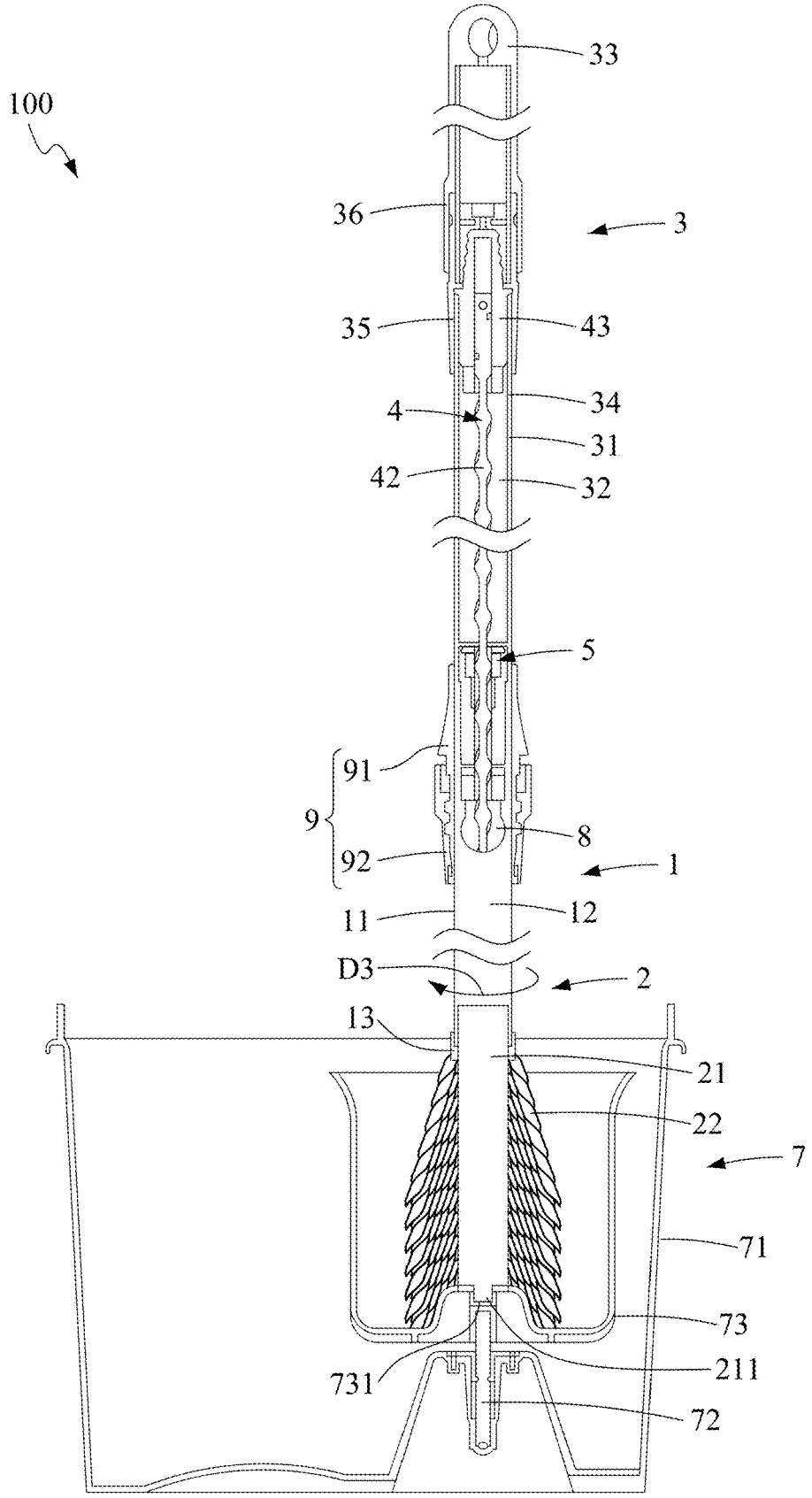
FIG. 4*b* is a schematic sectional view of the hand-press type rotary cleaning assembly according to the embodiment of the present invention in a working state.

As shown in FIGS. 4*a* and 4*b*, in the hand-press type rotary cleaning assembly 100 according to one embodiment of the present invention, the dehydrating device 7 includes a bucket 71, a rotary shaft 72 and a receiving assembly 73, the rotary shaft 72 is rotatably disposed in the bucket 71, an upper portion of the rotary shaft 72 inserts into the receiving assembly 73 to support the receiving assembly 73, the receiving assembly 73 is formed with an engaging portion 731 corresponding to the supporting portion 211 of the connecting rod body 2, the engaging portion 731 of the receiving assembly 73 is disposed at a top end of the rotary shaft 72 to receive the supporting portion 211 of the connecting rod body 2, the engaging portion 731 fully encloses the supporting portion 211, a lower portion of the rotary shaft 72 extends outside of the receiving assembly 73 and inserts to a base 711 of the bucket 71, wherein the whole base 711 is positioned below and outside of the receiving assembly 73 when the engaging portion 731 of the receiving assembly 73 receives the supporting portion 211 of the connecting rod body 2. In the embodiment of the present invention, the supporting portion 211 is formed protruding from the bottom end of the attaching rod 21, and the engaging portion 731 is recessed from the receiving assembly 73 corresponding to the supporting portion 211. However, the present invention is not limited to this, when the supporting portion 211 is recessed from the bottom end of the attaching rod 21, the engaging portion 731 is formed protruding from the receiving assembly 73 corresponding to the supporting portion 211 such that the supporting portion 211 and the engaging portion 731 are enable to engage with each other.

In detail, as shown in FIG. 4*b*, the connecting rod body 2 is received by the receiving assembly 73 in a manner that the supporting portion 211 is engaged with the engaging portion 731, the rotary rod 1 and the connecting rod body 2 rotate along the rotation direction D3, the rotary rod 1 and the connecting rod body 2 further drive the receiving assembly 73 to rotate along the rotation direction D3. At this moment, the receiving assembly 73 provides a stable support for the connecting rod body 2, such that the user is less likely to knock over the dehydrating device 7 during the dewatering process.

Furthermore, in cleaning and maintaining the hand-press type rotary cleaning assembly 100, the user may downwardly press the gripping rod 3 to rotate the connecting rod body 2 and the cleaning element 22 and perform a reciprocating motion of upwardly pulling the gripping rod 3 and then downwardly pressing to continue rotating the connecting rod body 2 and the cleaning element 22, thereby performing centrifugally dewatering. In addition, the present invention is not limited to the embodiment mentioned above, and in other embodiment, the blocking element 52 may be the blocking concave and the corresponding blocking element is the blocking tab.

As shown in FIGS. 1, 2*a*, 4*a* and 4*b*, in the hand-press type rotary cleaning assembly 100 according to one embodiment of the present invention, the connecting rod body 2 is a replaceable connecting rod body, and the connecting rod body 2 is detachably attached to the bottom end of the rotary rod 1, wherein a connecting rod assisting component 13 is further provided at the bottom end of the rotary rod 1, when a top end of the connecting rod body 2 is attached to the bottom end of the rotary rod 1, the connecting rod assisting component 13 has inner threads to screwed joint with outer threads provided at the up end of the attaching rod 21, or the connecting rod assisting component 13 has outer threads to screwed joint with inner threads provided at the up end of the attaching rod 21, such that the connecting rod body 2 is closely and firmly connected to the bottom end of the rotary rod 1. When the user intends to replace the connecting rod body 2 with a new connecting rod body after using the hand-press type rotary cleaning assembly 100 for a while, the user may rotates the connecting rod assisting component 13 relative to the rotary rod 1 in a direction opposite to the screwed direction for firmly connecting to detach the connecting rod body 2 from the bottom end of the rotary rod 1.

By the technical means adopted by the hand-press type rotary cleaning assembly 100 of the present invention, the cleaning element 22 can be directly cleaned and maintained by the present invention without spending additional time and energy to detach the cleaning element 22 from the connecting rod body 2 and then maintain or clean the cleaning element 22 by hand washing or by machine washing. The present invention is with merit, Compared to twisting and wringing by hands in prior arts, can more thoroughly remove the excess water on the cleaning element 22 by the centrifugal force, thereby improving the convenience of the user in usage, cleaning and maintenance, and to achieve time-saving and labor-saving effects.

The above description should be considered as only the discussion of the preferred embodiments of the present invention. However, a person having ordinary skill in the art may make various modifications without deviating from the present invention. Those modifications still fall within the scope of the present invention.

In this description, the present invention has been described with reference to particular embodiments thereof. However, it is clear that various modifications and transformations can still be made without departing from the spirit and scope of the present invention. Accordingly, the description and the accompanying drawings should be considered illustrative rather than restrictive.

What is claimed is:

1. A hand-press type rotary cleaning assembly, the hand-press type rotary cleaning assembly being a duster and including a cleaning-element-allocating zone having a cylindrical surface whose whole surface area is covered with a cleaning element, the hand-press type rotary cleaning assembly comprising:

a rotary rod having a rotary rod housing, wherein an inner surface of the rotary rod housing is a rotary-rod-inside hollow body;

a connecting rod body including an attaching rod and the cleaning element, wherein:

a top end of the attaching rod is attached to a bottom end of the rotary rod, a bottom end of the attaching rod is formed with a supporting portion, the cleaning-element-allocating zone is an entire area of a cylindrical surface of the attaching rod extending, and the cleaning element is covered around on the whole cylindrical surface of the cleaning-element-allocating zone;

a gripping rod having a gripping rod housing, wherein:

an inner surface of the gripping rod housing is a gripping-rod-inside hollow body, and the gripping-rod-inside hollow body accommodates the rotary rod such that the rotary rod is displaced in the gripping-rod-inside hollow body along an axis of the gripping-rod-inside hollow body;

a helix rod, wherein:

a top end of the helix rod is secured to a top end of the inner surface of the gripping rod housing, and a helix structure is provided on a surface of the helix rod;

a rotary guiding component firmly mounted within the rotary-rod-inside hollow body, wherein:

the rotary guiding component has a helix perforation, the helix rod passes through the helix perforation to helically rotate within the helix perforation to displace relative to the helix perforation such that when the helix rod moves along a pressing-down direction, and the helix structure drives the helix perforation to make the rotary guiding component rotate in a rotation direction; and a dehydrating device including a bucket, a rotary shaft and a receiving assembly, wherein:

the rotary shaft is rotatably disposed in the bucket, an upper portion of the rotary shaft inserts into the receiving assembly to support the receiving assembly, the receiving assembly is formed with an engaging portion corresponding to the supporting portion of the connecting rod body, the engaging portion of the receiving assembly is disposed at a top end of the rotary shaft to receive the supporting portion of the connecting rod body, the engaging portion fully encloses the supporting portion, a lower portion of the rotary shaft extends outside of the receiving assembly and inserts to a base of the bucket, and the whole base is positioned below and outside of the receiving assembly when the engaging portion of the receiving assembly receives the supporting portion of the connecting rod body.

2. The hand-press type rotary cleaning assembly as claimed in claim 1, wherein the cleaning element is a cloth cover.

3. The hand-press type rotary cleaning assembly as claimed in claim 1, wherein the rotary guiding component further has a blocking element located at an outer periphery of the rotary guiding component.

4. The hand-press type rotary cleaning assembly as claimed in claim 3, wherein the hand-press type rotary cleaning assembly further comprises:

a rotary driven element firmly mounted within the rotary-rod-inside hollow body and encircling around a radial outer surface of the rotary guiding component, wherein:

a corresponding blocking element is provided on a radial inner surface of the rotary driven element, the corresponding blocking element is corresponding in shape to the blocking element of the rotary guiding component when the blocking element extends outwardly while the rotary guiding component is rotating, the blocking element is attached to the rotary guiding component through a spin shaft, wherein the rotary rod, the gripping rod and the helix rod are provided extending along the pressing-down direction, the pressing-down direction is a direction opposite to a lifting-up direction, wherein:

when the gripping rod moves downwardly along the pressing-down direction and the rotary guiding component rotates in the pressing-down direction, the blocking element, which is hold by the spin shaft, swings outwardly by a centrifugal force to block the corresponding blocking element such that the rotary guiding component drives the rotary driven element, the rotary rod and the connecting rod body to rotate so as to rotate the attaching rod of the connecting rod body and the cleaning element covering the entire circumferential surface of the cleaning-element-allocating zone such that water in the connecting rod body is removed by the centrifugal force, and accordingly when an angular velocity of the rotary guiding component in the pressing-down direction is less than an angular velocity of the rotary driven element in the pressing-down direction, the blocking element swings inwardly such that the corresponding blocking element is not blocked by the blocking element, when the gripping rod moves upwardly along the lifting-up direction and the rotary guiding component rotates in the lifting-up direction, the corresponding blocking element is not blocked by the blocking element, and when the connecting rod body is placed on the receiving assembly in a manner that the supporting portion is engaged with the engaging portion and the connecting rod body rotates along the rotation direction, the connecting rod body drives the receiving assembly to rotate along the rotation direction.

5. The hand-press type rotary cleaning assembly as claimed in claim 4, wherein;

the blocking element is a blocking tab swingably disposed in an outer periphery of the rotary guiding component, and the corresponding blocking element is a blocking concave recessed in the rotary driven element.

6. The hand-press type rotary cleaning assembly as claimed in claim 1, wherein:

when the supporting portion is formed protruding from the bottom end of the attaching rod, the engaging portion is recessed from the receiving assembly corresponding to the supporting portion, or when the supporting portion is recessed from the bottom end of the attaching rod, the engaging portion is formed protruding from the receiving assembly corresponding to the supporting portion such that the supporting portion and the engaging portion are enable to engage with each other.

7. The hand-press type rotary cleaning assembly as claimed in claim 1, further comprising an auxiliary restraining assembly fixed to the helix rod and movably accommodated within the rotary rod.

8. The hand-press type rotary cleaning assembly as claimed in claim 1, further comprising a locking part located adjacent to an intersection of the rotary rod and the gripping rod and configured to secure a relative position between the rotary rod and the gripping rod.

9. The hand-press type rotary cleaning assembly as claimed in claim 1, wherein:

the rotary driven element includes a sleeve and a cap, the rotary guiding component is accommodated in the sleeve, and the cap covers the sleeve such that the rotary driven element is restrained in the sleeve.

10. The hand-press type rotary cleaning assembly as claimed in claim 1, wherein:

the connecting rod body is a replaceable connecting rod body, and a top end of the connecting rod body is detachably attached to the bottom end of the rotary rod.

* * * * *